US009410444B2

(12) United States Patent
Bacic

(10) Patent No.: US 9,410,444 B2
(45) Date of Patent: Aug. 9, 2016

(54) SHAFT BREAK DETECTION

(71) Applicant: ROLLS-ROYCE PLC, London (GB)

(72) Inventor: Marko Bacic, Oxford (GB)

(73) Assignee: ROLLS-ROYCE plc, London (GB)

( * ) Notice: Subject to any disclaimer, the term of this patent is extended or adjusted under 35 U.S.C. 154(b) by 811 days.

(21) Appl. No.: 13/667,220

(22) Filed: Nov. 2, 2012

(65) Prior Publication Data

US 2013/0133333 A1 May 30, 2013

(30) Foreign Application Priority Data

Nov. 29, 2011 (GB) ..... 1120511.9

(51) Int. Cl.

| | |
|---|---|
| ***F01D 21/04*** | (2006.01) |
| ***F01D 17/04*** | (2006.01) |
| ***F01D 17/06*** | (2006.01) |
| ***F01D 17/08*** | (2006.01) |
| ***F01D 21/00*** | (2006.01) |

(52) U.S. Cl.

CPC ..... *F01D 21/04* (2013.01); *F01D 17/04* (2013.01); *F01D 17/06* (2013.01); *F01D 17/08* (2013.01); *F01D 17/085* (2013.01); *F01D 21/003* (2013.01); *F01D 21/045* (2013.01)

(58) Field of Classification Search

CPC ..... F01D 17/04; F01D 17/06; F01D 17/08; F01D 17/085; F01D 21/04; F01D 21/003; F01D 21/045; F01D 21/06; F01D 21/14; F05D 2270/304; F05D 2270/09; F05D 2270/091; F05D 2270/021; F05D 2270/3013

See application file for complete search history.

(56) References Cited

U.S. PATENT DOCUMENTS

| | | | | |
|---|---|---|---|---|
| 5,363,317 | A * | 11/1994 | Rice et al. | 702/34 |
| 6,176,074 | B1 * | 1/2001 | Thompson et al. | 60/773 |
| 6,494,046 | B1 * | 12/2002 | Hayess | 60/779 |

FOREIGN PATENT DOCUMENTS

| | | | |
|---|---|---|---|
| GB | 2 256 486 | A | 12/1992 |
| WO | WO 94/10619 | A1 | 5/1994 |
| WO | WO 99/64727 | A1 | 12/1999 |
| WO | WO 00/36280 | A1 | 6/2000 |

OTHER PUBLICATIONS

Dec. 30, 2011 British Search Report issued in British Patent Application No. GB1120511.9.

* cited by examiner

*Primary Examiner* — Richard Edgar
*Assistant Examiner* — Brian P Wolcott
(74) *Attorney, Agent, or Firm* — Oliff PLC

(57) ABSTRACT

The present invention provides a method of detecting shaft break in a shaft system comprising a shaft coupled between two masses. The method comprises a number of steps. Firstly, to define a time-dependent rotational speed equation for the shaft in terms of system inertia for an engine transient event. Then to discretize the rotational speed equation in terms of a discrete time constant in the discrete domain. Then to recursively define the discretized equation to give a recursive equation and to solve the recursive equation to determine the discrete time constant. Then to define a threshold as a function of engine power and then to set a shaft break signal to TRUE if the discrete time constant is greater than the threshold. A shaft break detection system is also provided by the present invention.

18 Claims, 4 Drawing Sheets

SHAFT BREAK DETECTION

The present invention relates to a method of detecting shaft break and a shaft break detection system. It finds particular, though not exclusive, utility in detecting shaft breakage in a gas turbine engine.

It is an object of the present invention to provide a more accurate and more timely method and system of detecting shaft break.

Accordingly the present invention provides a method of detecting shaft break in a shaft system comprising a shaft coupled between two masses, the method comprising steps to: define a time-dependent rotational speed equation for the shaft in terms of system inertia for an engine transient event; discretize the rotational speed equation in terms of a discrete time constant in the discrete domain; recursively define the discretized equation to give a recursive equation; solve the recursive equation to determine the discrete time constant; define a threshold as a function of engine power; and set a shaft break signal to TRUE if the discrete time constant is greater than the threshold.

Advantageously, this method is robust to high frequency noise. Additionally it can be applied to any shaft system with minimal set up burden, as only the system inertia is required.

The rotational speed equation may be a first order linearised equation that approximates the shaft system. The rotational speed equation may be exponential in terms of an inverse time constant of speed decay. The inverse time constant of speed decay is inversely proportional to inertia of the shaft system. The inertia of the shaft system may be equal to the sum of the inertias of the masses.

The discrete time constant may be defined as an exponential of the sampling rate.

The recursive equation may be solved using a recursive least squares method. The recursive least squares method may use the last n speed samples, wherein n may be in the range 4 to 20. More preferably n may be in the range 8 to 12.

The steps of solving the recursive equation, defining the threshold and setting the shaft break detection signal may be performed iteratively. Thus they may be performed each time a speed sample is taken, or after a group of speed samples have been taken.

The method may further comprise a step of sampling the rotational speed of the shaft before the step of solving the recursive equation. This step may also be performed iteratively with the following three steps.

The shaft system may be a gas turbine engine shaft system, particularly an intermediate pressure shaft system. Alternatively it may be a high pressure or a low pressure shaft system. The two masses may comprise a compressor and a turbine of a gas turbine engine.

The engine power may be indicated by at least one engine parameter. The at least one engine parameter may be one of the group comprising altitude, compressor exit pressure, another shaft speed, lagged compressor exit pressure and corrected shaft speed of another shaft.

The engine transient event may comprise surge. Surge initially may similar characteristics to a shaft break event.

The present invention also comprises a gas turbine engine comprising a method as described above.

The present invention also comprises a shaft break detection system comprising: a shaft coupled between two masses; at least one sensor to sample rotational speed of the shaft; a processor to process the sampled speed to recursively solve a discretized rotational speed equation to determine a discrete time constant; a processor to determine a threshold as a function of engine power; and a comparator to set a shaft break detection signal to TRUE if the discrete time constant is greater than the threshold.

Advantageously, the system of the present invention sets a shaft break detection signal that is robust to high frequency noise. Additionally the set up burden is small as a shaft system is likely to already comprise a speed sensor; the remainder of the elements may be implemented in software if desired. Alternatively the elements may be implemented in hardware or a combination of hardware and software.

The system may comprise a sensor to sense an engine power parameter. The engine power parameter may be one of the group comprising altitude, compressor exit pressure, another shaft speed, lagged compressor exit pressure and corrected shaft speed of another shaft.

The system may further comprise memory to store the last n speed samples, where n may be in the range 4 to 20, more preferably 8 to 12.

The two masses may comprise a compressor and a turbine of a gas turbine engine. Alternatively the two masses may be a torque generator and a load.

The present invention also comprises a gas turbine engine comprising a system as described.

The present invention will be more fully described by way of example with reference to the accompanying drawings, in which.

Figure 1:
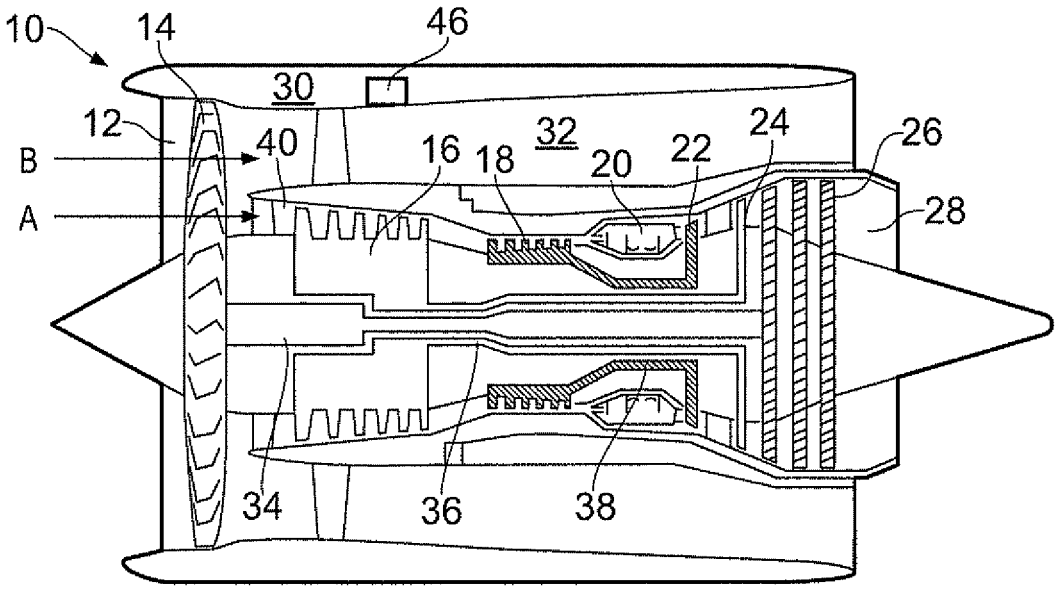
FIG. 1 is a sectional side view of a gas turbine engine.

A gas turbine engine 10 is shown in FIG. 1 and comprises an air intake 12 and a propulsive fan 14 that generates two airflows A and B. The gas turbine engine 10 comprises, in axial flow A, an array of inlet guide vanes 40, an intermediate pressure compressor 16, a high pressure compressor 18, a combustor 20, a high pressure turbine 22, an intermediate pressure turbine 24, a low pressure turbine 26 and an exhaust nozzle 28. The fan 14 is coupled to the low pressure turbine 26 by a low pressure shaft 34. The intermediate pressure compressor 16 is coupled to the intermediate pressure turbine 24 by an intermediate pressure shaft 36. The high pressure compressor 18 is coupled to the high pressure turbine 22 by a high pressure shaft 38.

A nacelle 30 surrounds the gas turbine engine 10 and defines, in axial flow B, a bypass duct 32. A control system 46, such as an electronic engine controller (EEC), is provided on the engine 10 and is configured to control aspects of the operation of the engine 10.

In rare circumstances one of the shafts 34, 36, 38 may break. When this occurs the fan 14 or compressor 16, 18 decelerates rapidly because it is no longer driven. However, the turbine 22, 24, 26 rapidly accelerates because the load on it is substantially reduced. This in turn may cause the turbine disc to burst releasing high energy debris and resulting in catastrophic failure of the engine 10. Where the engine 10 is used to power an aircraft the released high energy debris may not be captured and there is thus a risk of some debris impacting or piercing the fuselage of the aircraft. Therefore there is a need to identify shaft breakages and to shut down the engine 10 quickly by shutting off the fuel supply. Typically a shaft break event must be controlled in less than 1 second or the release of high energy debris cannot be reliably prevented.

Figure 2:
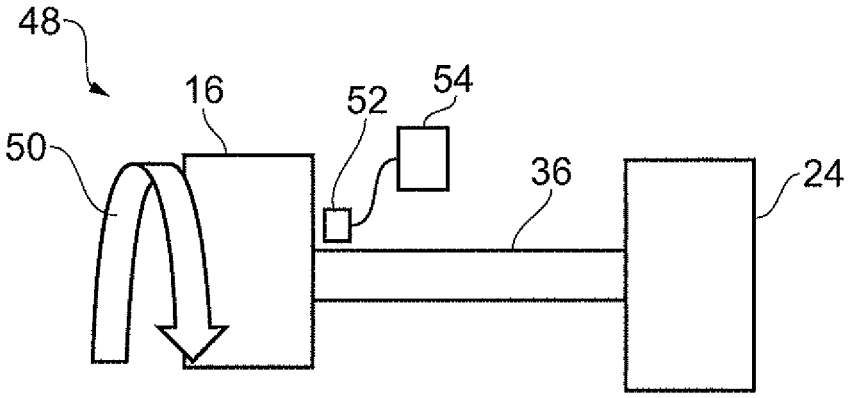
FIG. 2 and FIG. 3 are a schematic illustration of a shaft system in unbroken and broken configurations.

A simplistic illustration of a shaft system 48, for example the intermediate pressure shaft system, is shown in FIG. 2. The shaft system 48 comprises the intermediate pressure shaft 36 coupled between the intermediate pressure compressor 16 and the intermediate pressure turbine 24. The shaft system 48 rotates as a whole as indicated by arrow 50. A measuring device 52 is arranged to measure the rotational speed of the intermediate pressure shaft 34 and is coupled to a processor 54. The measuring device 52 is preferably a speed probe located close to the intermediate pressure compressor 16. The measuring device 52 may measure the rotational speed substantially continuously or may sample the rotational speed at defined intervals. This interval may be in the range 1 ms to 30 ms. Preferably samples are taken every 3 ms to 5 ms. Alternatively the measuring device 52 may measure the rotational speed indirectly, for example by measuring the frequency of phonic wheel teeth passing a fixed point. The processor 54 receives the measured rotational speed from the measuring device 52 and processes it as will be described below.

The intermediate pressure compressor 16 has inertia $J_c$ whilst the intermediate pressure turbine 24 has inertia $J_t$. The inertias are known properties of the shaft system 48.

Figure 3:
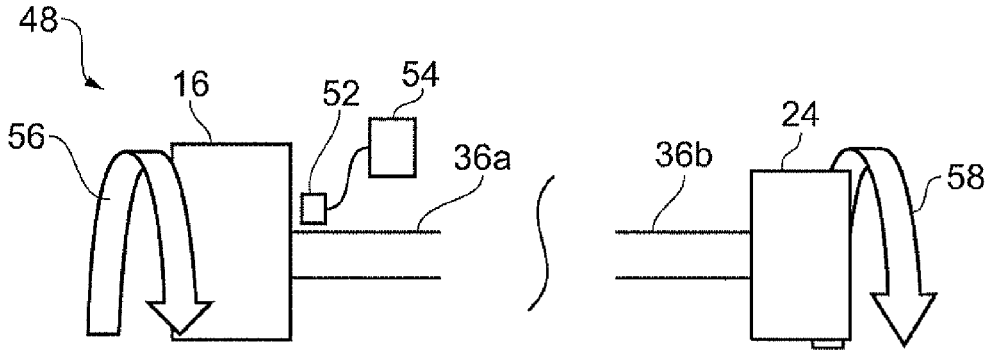

FIG. 3 shows the intermediate pressure shaft system 48 when the intermediate pressure shaft 36 has broken in a shaft break event. Thus the intermediate pressure shaft 36 comprises a first portion 36*a* that remains coupled to the intermediate pressure compressor 16 and a second portion 36*b* that remains coupled to the intermediate pressure turbine 24. Although drawn approximately equal in length, it will be apparent to the skilled reader that the first portion 36*a* and second portion 36*b* of the intermediate pressure shaft 36 may be different lengths depending on where the break occurs and the cause of the break. Equally the break may not be a clean break but may leave jagged ends to the first and second portions 36*a*, 36*b*.

In normal operation the turbine 24 drives the compressor 16 at a rotational speed resulting in the rotation 50 shown in FIG. 2. In the event of a shaft break the turbine 24 no longer drives the compressor 16 which therefore continues to rotate in the same direction but decelerates rapidly as indicated by arrow 56. Meanwhile the turbine 24 accelerates as indicated by arrow 58 because it no longer experiences such a large load.

In normal operation the intermediate pressure shaft system 48 behaves as a third order mechanical system which can be approximated by a first order system. Such an approximation is sufficiently accurate to show relatively long term trends (>50 ms) in speed reduction.

Figure 4:
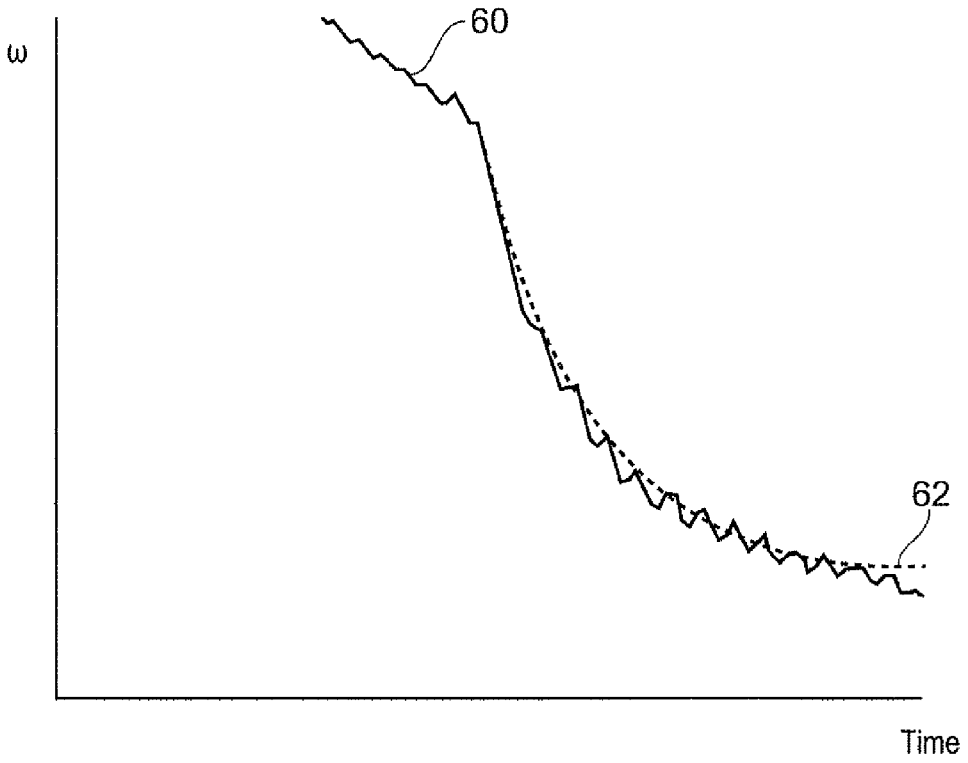
FIG. 4 is a graph showing an engine transient event and its first order fitted line.

FIG. 4 is a graph of the speed of the intermediate pressure shaft 36, as measured by the speed probe 52, as a function of time. Line 60 shows an exemplary profile when the gas turbine engine 10 surges, which is an engine transient event. The first order approximation can be used to fit a curve to the line 60, first order fit line 62. The equation governing this line 62 is a first order differential, linearised, rotational speed equation in the form $$(J_c + J_t)\frac{d\omega}{dt} = -c\omega + \tau$$

where $$\omega(t) = \omega(0)e^{-\alpha t} + e^{-\alpha t}\int_0^t \frac{\tau}{J_c + J_t}e^{\alpha t}\,dt.$$

The rotational speed measured by the speed probe 52 is ω and the total torque of the system is τ, being the sum of the torque of the intermediate pressure compressor 16 and the intermediate pressure turbine 24. The exponential factor α is an inverse time constant of speed decay in the continuous domain and is defined as $$\frac{c}{J_c + J_t}$$

where c is a damping factor, which is unknown.

Figure 5:
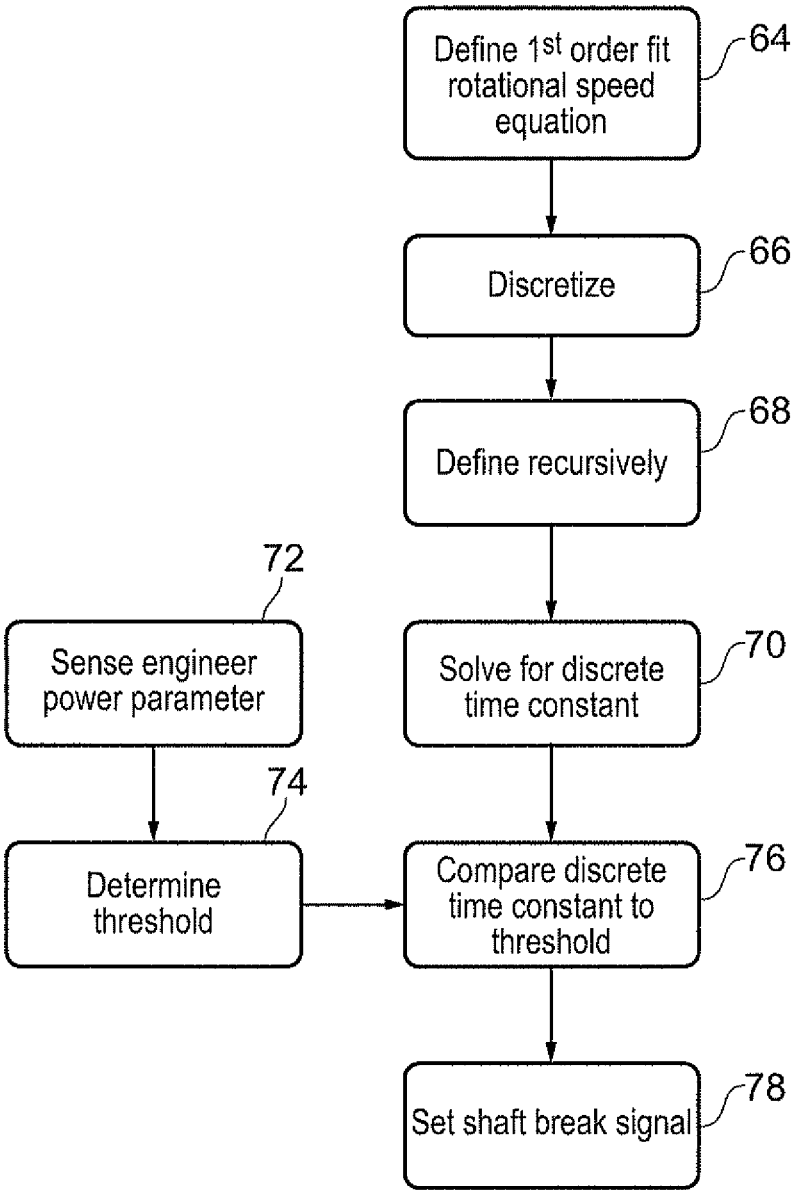
FIG. 5 is a flow chart of the method according to the present invention.

FIG. 5 is a flow chart of the method of detecting shaft break according to the present invention. Thus the first step 64 comprises defining the linearised first order rotational speed equation as described above.

For a shaft break event, the rotational speed ω measured by the speed probe 52 initially follows a similar profile over time but then deviates. When a shaft break event occurs there is a sudden change in system torque from $\tau_0$ to $\tau_0-\Delta\tau$, where $\tau_0$ is the initial torque, because only the compressor 16 remains coupled to the first portion 36*a* of the shaft 36. By defining $\omega_0$ as the rotational speed at which a shaft break event occurs, and substituting into the equation for ω(t), the first order rotational speed equation can be written in the form $\omega(t)=Ae^{-\alpha t}+B$ where $$B = \frac{\tau_0 - \Delta\tau}{c}$$

and $A=\omega_0-B$.

The second step 66 of the method comprises discretizing the rotational speed equation. This is achieved by sampling the rotational speed ω at a rate T to give the $k^{th}$ speed sample as $\omega(kT)=Ae^{-\alpha kT}+B$. The discretized equation can be defined recursively, the third step 68 of the method, as $\omega((k+1)T)=\beta\omega(kT)+(\beta-1)B$, where $\beta=e^{-\alpha T}$ is a discrete time constant, that is the time constant of speed decay in the discrete domain.

The fourth step 70 of the method of the present invention requires that the recursive equation be solved for the discrete time constant β. Preferably the recursive equation is solved using the recursive least squares method, an algorithm known to the skilled reader. This is an iterative method that requires the last n points to be used, where n is an integer. In a preferred embodiment n is in the range 4 to 20; more preferably 8 to 12.

A parallel step of the method of detecting shaft break according to the present invention requires sensing of at least one engine parameter, step 72, that is indicative of engine power. Typical parameters include altitude, other shaft speeds, 'raw' or corrected, and compressor exit pressure (P30), which may be lagged. However, other parameters or combinations of parameters known to the skilled reader may be substituted with equal felicity.

Figure 6:
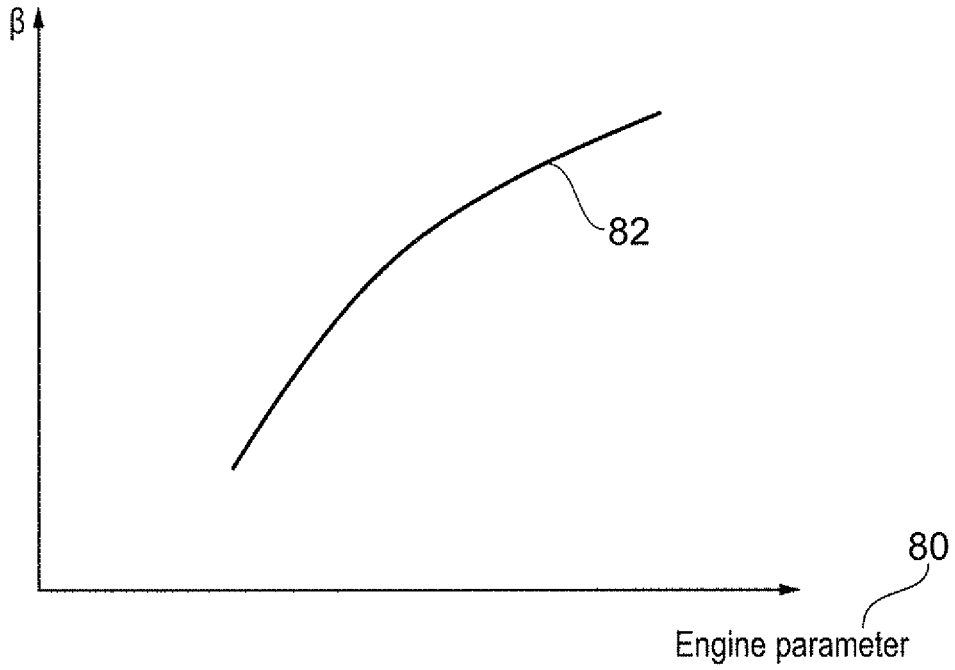
FIG. 6 is an exemplary look up graph for use in the method according to the present invention.

At step 74 a look up table, graph, function or other mechanism is provided to convert the at least one sensed parameter value to a threshold. An exemplary look up graph is shown in FIG. 6 which plots the discrete time constant β against an engine parameter 80. The threshold 82 is a line in this two-dimensional space. It will be understood that the threshold 82 may be a function of two or more engine parameters 80, in which case the line may be visualised as a plot in three or more dimensions. For a threshold 82 that depends on multiple parameters a functional, rather than graphical, look up may be more appropriate.

At step 76 the discrete time constant β is compared to the threshold in a comparator, the output of which is used to set a shaft break signal at step 78. If the discrete time constant β is greater than the determined threshold, thus the calculated β is above the threshold line 82 in FIG. 6, the shaft break signal is set to FALSE. Conversely, if the discrete time constant β is less than the determined threshold, thus the calculated β is below the threshold line 82 in FIG. 6, the shaft break signal is set to TRUE.

The shaft break signal can then be provided to the control system 46 of the gas turbine engine 10 which causes safe and rapid engine shutdown. For example, if the TRUE shaft break signal is received by the control system 46, it may cause the fuel supply to the engine 10 to be cut off or a fuel metering valve to be slewed towards closed. Either of these actions will starve the engine 10 of fuel and cause it to shut down. Alternatively or additionally, variable geometry vanes in the engine 10 may be slewed to cause the engine 10 to surge and thereby accelerate dissipation of energy.

The present invention also comprises a shaft break detection system for a shaft system such as the intermediate pressure shaft system 48. The shaft break detection system includes a processor, for example processor 54, that receives the sampled rotational speed ω(kT) from the speed probe 52 and recursively solves the recursive equation to determine the discrete time constant β. The shaft break system also includes a processor, which may be the same or another processor, that determines the threshold 82 from the at least one parameter 80 indicative of engine power. This processor comprises the look up table, graph, function or other mechanism described with respect to step 74 of the method. The shaft break detection system also includes a comparator to compare the discrete time constant β to the threshold 82.

The system may comprise one or more sensors to sense the one or more engine parameters 80. There may also be memory associated with the processor or processors to store the data points for the solution of the recursive equation.

Although the method according to the present invention has been described as incorporating the recursive least squares method to determine the discrete time constant β, it will be apparent that other methods of solving the recursive equation may be substituted with equal felicity. For example, a Kalman filter may be used.

Although the method of the present invention has been described with respect to the intermediate pressure shaft system 48, it is equally applicable to the high pressure shaft system comprising the high pressure compressor 18, the high pressure shaft 38 and the high pressure turbine 22 or to the low pressure shaft system comprising the fan 14, the low pressure shaft 34 and the low pressure turbine 26.

The present invention has been envisaged for use in a gas turbine engine 10 for propelling an aircraft since the effects of shaft breakage are potentially catastrophic. However, the present invention also has utility for other types of gas turbine engine 10 including for marine applications and for industrial applications such as gas and oil pumping engines.

The invention claimed is:

1. A method of detecting shaft break in a shaft system comprising a shaft coupled between two masses, the method comprising steps to:

define a time-dependent rotational speed equation for the shaft in terms of system inertia for an engine transient event;

discretize the rotational speed equation in terms of a discrete time constant in a discrete domain;

recursively define the discretized equation to give a recursive equation;

solve the recursive equation to determine the discrete time constant;

define a threshold as a function of engine power, wherein the threshold is a value of the discrete time constant calculated as the function of engine power; and set a shaft break detection signal to TRUE and reduce or stop a drive to the shaft if the discrete time constant is less than the threshold.

2. A method as claimed in claim 1 wherein the rotational speed equation is a first order linearised equation that approximates the shaft system.

3. A method as claimed in claim 1 wherein the rotational speed equation is exponential in terms of an inverse time constant of speed decay.

4. A method as claimed in claim 3 wherein the inverse time constant of speed decay is inversely proportional to an inertia of the shaft system, wherein the inertia of the shaft system is equal to the sum of the inertias of the masses.

5. A method as claimed in claim 1 wherein the recursive equation is solved using a recursive least squares method using a last n speed samples wherein n is in the range 4 to 20.

6. A method as claimed in claim 1 wherein the steps of solving the recursive equation, defining the threshold and setting the shaft break detection signal are performed iteratively.

7. A method as claimed in claim 1 further comprising a step of sampling a rotational speed of the shaft before the step of solving the recursive equation.

8. A method as claimed in claim 1 wherein the shaft system is a gas turbine engine shaft system.

9. A method as claimed in claim 8 wherein the two masses comprise a compressor and a turbine of a gas turbine engine.

10. A method as claimed in claim 1 wherein engine power is indicated by at least one engine parameter of the group comprising: altitude, compressor exit pressure, another shaft speed, lagged compressor exit pressure, corrected shaft speed of another shaft.

11. A method as claimed in claim 1 wherein the engine transient event comprises engine surge.

12. A gas turbine engine comprising a method as claimed in claim 1.

13. A shaft break detection system comprising:

a shaft coupled between two masses;

at least one sensor to sample rotational speed of the shaft;

a processor to process the sampled speed to recursively solve a discretised rotational speed equation to determine a discrete time constant;

a processor to determine a threshold as a function of engine power, wherein the threshold is a value of the discrete time constant calculated as the function of engine power; and a comparator to set a shaft break detection signal to TRUE in order to reduce or stop a drive to the shaft if the discrete time constant is less than the threshold.

14. A system as claimed in claim 13 further comprising a sensor to sense an engine power parameter of the group comprising: altitude, compressor exit pressure, another shaft speed, lagged compressor exit pressure and corrected shaft speed of another shaft.

15. A system as claimed in claim 13 further comprising memory to store the last n speed samples.

16. A system as claimed in claim 13 wherein the two masses comprise a compressor and a turbine of a gas turbine engine.

17. A system as claimed in claim 13 wherein the two masses are a torque generator and a load.

18. A gas turbine engine comprising a system as claimed in claim 13.

* * * * *